United States Patent [19]

Drugmand

[11] 4,295,035

[45] Oct. 13, 1981

[54] DOUBLE-GRIP MOUNTING MEANS FOR SHEATHED HEATING ELEMENTS

[75] Inventor: Lester D. Drugmand, Arnold, Md.

[73] Assignee: Electro-Therm, Inc., Laurel, Md.

[21] Appl. No.: 185,994

[22] Filed: Sep. 10, 1980

[51] Int. Cl.[3] ..... H05B 3/06

[52] U.S. Cl. ..... 219/536; 219/336; 219/523; 219/402; 219/542; 29/611; 338/315

[58] Field of Search ..... 219/316, 318, 335, 336, 219/402, 404, 403, 523, 536, 537, 541, 542, 544; 29/611; 227/51, 55; 60/121; 403/197; 151/69; 338/228, 315, 316

[56] References Cited

U.S. PATENT DOCUMENTS

| | | | |
|---|---|---|---|
| 495,753 | 4/1893 | Platt | 227/51 |
| 630,675 | 8/1899 | Ferrall | 60/121 |
| 2,670,529 | 3/1954 | Thomas | 219/544 X |
| 2,748,251 | 5/1956 | Drummand | 219/336 |
| 2,757,271 | 7/1956 | Fitzgerald | 219/523 X |
| 2,799,767 | 7/1957 | Bremer | 219/541 X |
| 2,810,815 | 10/1957 | Dicome | 219/336 |
| 3,012,800 | 12/1961 | Koch | 403/197 |
| 3,209,806 | 10/1965 | Currier et al. | 151/69 |
| 3,354,294 | 11/1967 | Kollar et al. | 219/536 |
| 3,525,849 | 8/1970 | Blockmann | 219/318 |
| 3,657,519 | 4/1972 | Pease | 219/536 |
| 3,732,388 | 5/1973 | Pease | 219/536 |
| 3,778,592 | 12/1973 | Williams | 219/536 |
| 3,859,721 | 1/1975 | Cunningham et al. | 29/611 |
| 3,899,658 | 8/1975 | Yartz | 219/536 |
| 3,930,140 | 12/1975 | Pease | 219/316 |
| 3,934,116 | 1/1976 | Cunningham et al. | 219/336 |
| 3,943,328 | 3/1976 | Cunningham | 219/335 |
| 4,099,319 | 7/1978 | Vogel | 29/611 |
| 4,168,423 | 9/1979 | Gilreath | 219/402 |
| 4,241,291 | 12/1980 | Carnes | 219/536 |

*Primary Examiner*—Volodymyr Y. Mayewsky
*Attorney, Agent, or Firm*—Low & Low

[57] ABSTRACT

A means for attaching and securing an apertured mounting bracket to a sheathed electric heating element received therethrough to insure firm mechanical support, preclusion of relative axial motion, reliable electrical grounding, and ease of adaptation to automated assembly, characterized by an initially flangeless sleeve shaped to form a double grip at opposite ends to the heating element with the bracket clamped therebetween.

6 Claims, 7 Drawing Figures

DOUBLE-GRIP MOUNTING MEANS FOR SHEATHED HEATING ELEMENTS

BACKGROUND OF THE INVENTION

In the assembly of appliances having sheathed electric heating elements of usual manufacture, it is necessary to provide mounting, support, or hinge brackets which are attached to the appliance housing and which are commonly apertured to receive therethrough a portion of the elongated sheathed heating element or elements.

In an effort to provide proper support for, prevent relative movement between, and provide good electrical contact with the bracket and the sheath for grounding or like purposes, the bracket has heretofore been affixed to the heating element as by brazing, welding, crimping, or the like. Illustrative of such prior art assemblies are the patents to Thomas, U.S. Pat. No. 2,670,529, Bremer U.S. Pat. No. 2,799,767, Yartz U.S. Pat. No. 3,899,658 and Pease U.S. Pat. No. 3,930,140.

Further, as the bracket is frequently formed from stainless steel for, flexibility, durability, ease of cleaning, and general eye appeal, it has hitherto been necessary to fabricate a multi-part connection between the bracket and heating element in order to effect the desired metal joining technique to be employed, as welding, crimping, etc. Such fabrication inherently introduces cost and handling complexity into the assembly, as when a suitable element-connectable steel plate must be first secured to the stainless steel bracket as by individual rivets prior to the actual subsequent connection to the heating element portion.

Pending application Ser. No. 019,120, filed Mar. 9, 1979, illustrates and thereafter issued as U.S. Pat. No. 4,241,291 on Dec. 23, 1980 and an improvement upon the prior art in the use of a single flanged tubular insert for mounting a sheathed heating element to a planar bracket member. The tubular insert shown in the drawings in the referenced application is of an eyelet-like configuration, with a tubular extension, that extends through an aperture in a planar mounting bracket and encases the heating element. The tubular extension is axially compressed and buckled against the mounting bracket to form a second outwardly extending flange that grips the sheathed heating element and fixes the element in relation to the planar bracket.

The present invention further improves upon such mounting structure and will simplify the necessary materials while producing more effective gripping action then the improved mounting of the above-mentioned pending application.

BRIEF DESCRIPTION OF THE INVENTION

The complexities of multi-element handling with resultant labor and time expense are overcome by the improved mounting means of the present invention which provides a double-grip simplified mounting assembly.

To this end, the thin, substantially planar bracket member has an aperture therethrough of greater diameter than that of the sheathed heating element portion to be received therein. A flangeless and cylindrical metallic sleeve is slipped over the sheathed heating element, encasing the linear portion of the element that is within the aperture of the planar bracket. The tubular member is placed so that it extends outwardly from both sides of the planar bracket.

Thereafter, appropriate tools are used to axially compress and buckle the sleeve to form outwardly extending reversely folded flange-like portions on each side of the aperture. The flange-like portions merge into radially inwardly extending terminal flanges, the inner periphery of which define openings smaller than the sheath and bite or indent thereinto. The indenting of the sheath forms a gripping mechanism on both sides of the bracket and inwardly from which the flange-like portions sandwich the bracket, so as to fix the heating element and bracket in relation to each other. This mounting means provides excellent mechanical support and electrical contact throughout.

Inasmuch as the assembly is effected with but a single tubular insert associated with the sheath and bracket, not only are economies of material achieved, but also a reduction in the numbers of parts being handled as well as the required operations thereon. The fabrication of the insert from a flangeless tubular sleeve provides that no preworking of pieces is necessary before assembly, thereby further simplifying the assembly.

The mounting means of the invention constitutes in effect a single step assembly, lending itself admirably to high speed, automated handling by equipment presently available in the art, as vibratory singulating and orienting feeders and hammer-anvil die sets, for example.

BRIEF DESCRIPTION OF THE DRAWINGS

The invention will be better understood in connection with the accompanying drawings, in which.

DETAILED DESCRIPTION OF THE INVENTION

Figure 1:
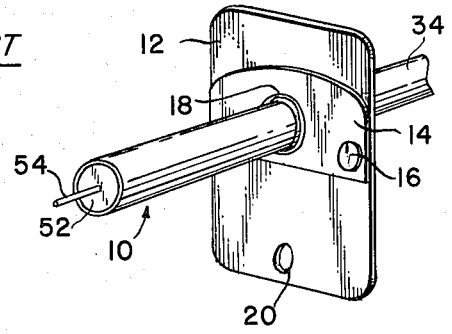
FIG. 1 PRIOR ART
FIG. 1 is a perspective view of a typical mounting means for a sheathed heating element as employed prior to my invention.

Referring to the drawings, and as indicated above, diverse means have been employed in the prior art in mounting conventional metallic sheathed heating elements as at 10 in brackets for association with equipment housings. Thus, in the exemplary prior art illustration of FIG. 1, a typical relatively thin bracket member 12 has secured thereto a mounting plate 14. The plate 14 may be affixed to the bracket as by rivets 16, preferably two or more so as to preclude relative rotation between the plate and bracket in handling. Plate 16 may have an aperture surrounded by an annular boss 18 through which heating element 10 extends, the bracket 12 having a like aperture aligned therewith. The boss 18 may be swaged into supportive engagement with the sheath, or welded thereto, etc. as indicated. A hole or holes 20 in the bracket may provide for securement of the bracket to an equipment housing, as by one or more sheet metal screws or bolts.

It will be seen that the manipulative and mechanical operations required for such assemblies, as well as the number of parts required are rather burdensome. Plural operations on the several pieces are required, with attendant labor effort, time delay and increased probability of defective or unacceptable assemblies.

Figure 4:
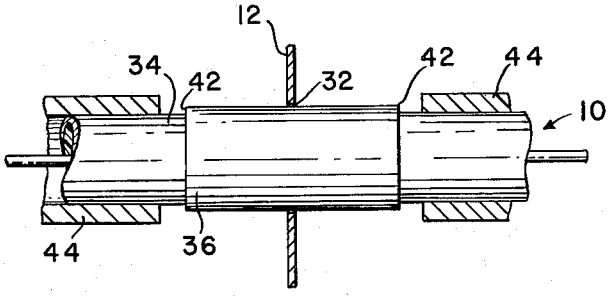
FIG. 4 is a side elevation of the heating element and tubular insert as initially assembled with the bracket, along with illustrative die members shown fragmentarily in section.

The assembly 30, FIG. 4, of my invention obviates the difficulties alluded to above. The bracket 12, as before, is apertured at 32 to a diameter greater than that of outer metallic sheath 34 of heating element 10 received therethrough. Interposed between the bracket aperture 32 and sheath 34 in concentric relation to the latter is the tubular sleeve 50. While the drawings illustrate a cylindrical heating element sheath and a cylindrical insert sleeve, no limitation is placed on the cross sectional configuration of these members, and which therefore may be elliptical, rectangular, etc. within the scope the invention.

The tubular gripping insert is formed from a flangeless tubular sleeve 36, best seen in FIG. 4. The sleeve 36 is positioned so that portions of the sleeve extend on both sides of the planar bracket element 12, and terminate in the annular edges 42. The sleeve 36 snugly and slidably embraces the sheath.

No other components are required in effecting the assembly, and it will be seen that the use of tubular sleeve 36 facilitates the automatic or semi-automatic handling thereof wherein the insert alone or the sleeve 36 and the bracket 12 together may be mechanically dropped or slipped along the elongated sheath to the desired position of securement.

With the bracket and sleeve so located, as in FIG. 4, edges 42 may then face toward appropriate shaping tools 44 which may be suitably split to fit about the sheath. The tools 44 are positioned to be rapidly and forcibly advanced against the terminal edges 42 of sleeve 36.

Figure 3:
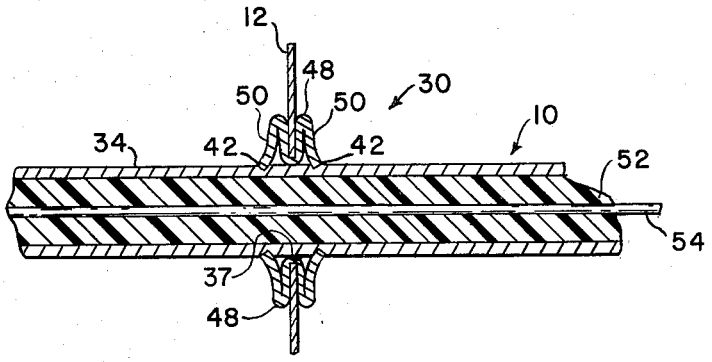
FIG. 3 is an enlarged view in sectional side elevation of the mounting means, portions of the heating element and the bracket being broken away.
Figure 5:
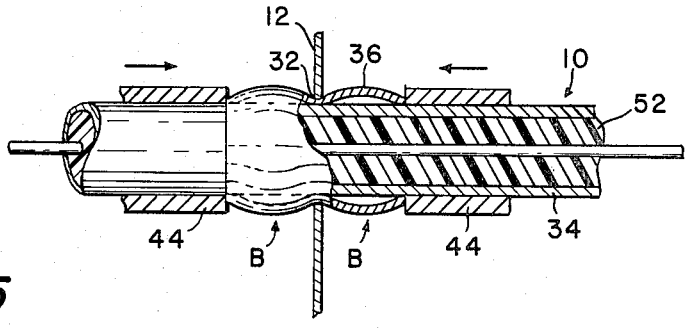
FIG. 5 is similar to FIG. 4 illustrating a typical initial step in compressing and buckling the tubular insert.
Figure 6:
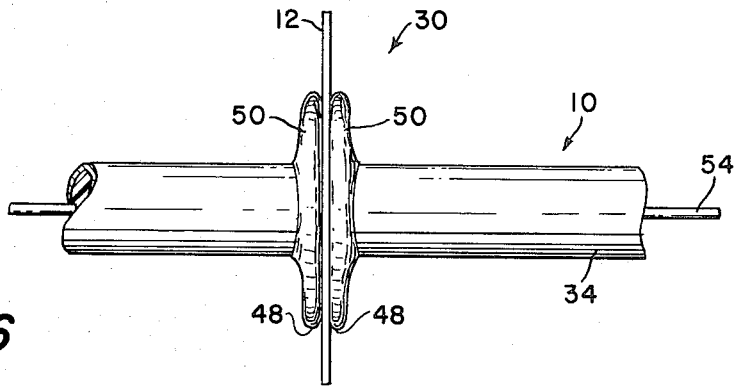
FIG. 6 is a side elevation showing the tubular insert at the completion of the die operation as fully collapsed to secure the heater sheath as in FIG. 3.

With the heating element therein, the extended portions of sleeve 36 are constrained to buckle radially outwardly at B as seen in FIG. 5 as the tools advance. Continued tool movement to the FIG. 6 position collapses the tubular sleeve 36 as shown to provide a flange-like radially outwardly extending portion 48 (FIG. 3) which reversely bends and merges into a terminal flange 50. In the final collapsing action, the edges 42 of the sleeve define annular openings of lesser diameter than sheath 34, and thereby indent or deform the sheath about its periphery thereat. Also, that intermediate portion of the sleeve 36 at 37 that is in contact with the edge of bracket aperture 32 forms a deflection in the underlying sheath 34 to more securely grip the mounting bracket to the sheath at that point. Such deflection may be on the order of 0.001"–0.004", for example.

The indentations and deflections are not excessive, and no undue pressure is exerted upon the magnesium oxide or other insulative sheath filler 52 about element cold lead 54 that would damage the element. If desired, the tools 44 may have their working faces shaped so as to enhance the inward deforming action of the annular sleeve edges 42 as they advance axially thereagainst.

In this manner, the heating element 10 is securely mounted to the stainless steel or like spring steel bracket 12 at two places with no likelihood of axial slippage. Further, the insert 50 which may be of stainless steel, effects excellent, protected electrical contact with bracket 12 in the U-shaped clamped portion thereof defined by flanges 48 and the axially extending length therebetween in bracket aperture 32.

In like manner, the reversely turned inwardly extending terminal flanges 50 are deformably engaged with sheath 34 at edges 42, the mechanical connection being secure and the electrical connection as for grounding purposes being reliable and protected against deterioration, in addition to the electrical connection established through gripping engagement of the intermediate portion at aperture 32 with the heater sheath. It will be seen that as a result of the axial compression, the edges 42 effectively bite into the heater sheath 34 in opposite directions. As a consequence, any attempted motion of the sheath perpendicular to the bracket will be strongly resisted. Thus, left-hand edge 42 (FIG. 3) will constrain any rightward movement of the sheath, while right-hand edge 42 will prevent leftward motion.

Figure 2:
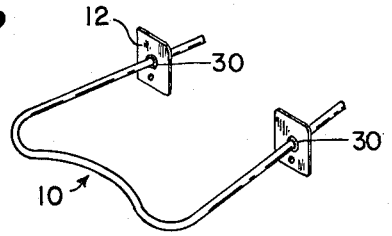
FIG. 2 is a general perspective view in reduced scale of a heating element having a configuration for a typical installation and including the bracket mounting means of my invention adjacent each end thereof.

In certain housing environments it is desirable to secure and support the heater element at more than one point, as by providing a pair of brackets adjacent terminal ends in FIG. 2. In like manner, plural support along a single linear extent thereof may also be effected by means of plural brackets and sleeves.

In handling the elements prior to final assembly, an initial bow, as indicated by B in FIG. 5 may be formed following slight axial compression. This initial bow will increase friction between the sleeve and bracket thus to temporarily fix the pieces in their proper position, so that other subsequent handling or other operations may be carried out without the pieces separating. The final flange 50 as in FIG. 6 may be formed after any other manufacturing operations have been completed. This is only illustrative of one method of temporarily fixing the pieces before final assembly. Other methods can also be used to accomplish this end.

Figure 7:
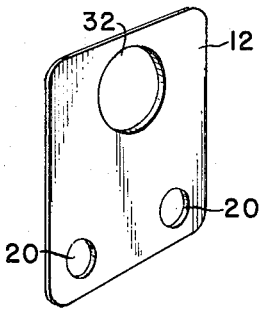
FIG. 7 is a perspective view of a typical mounting bracket.

FIG. 7 illustrates the typical mounting bracket 12, the aperture 32 and the holes 20 for securing the piece to the final product.

This mounting means is an improvement to the single piece insert disclosed in pending application Ser. No. 019,120 filed Mar. 9, 1979 now U.S. Pat. No. 4,241,291. The use of a flangeless tubular sleeve for the insert provides that no preworking of the insert piece is necessary before assembly. Also the insert in this invention is provided with a dual gripping means, so that the sheathed heating element is gripped on both sides of the mounting bracket. For the above reasons the described invention provides far more economical assembly and more secure mounting as set forth.

Although the best mode contemplated for carrying out the present invention has been herein shown and described, it will be apparent that modification and variation thereof may be made without departing from what is regarded to be the subject matter of the invention.

What I claim is:

1. A double-grip mounting assembly for securing a sheathed metallic electric heating element to a metallic bracket having an aperture thereon, comprising in combination, a sheathed metallic electric heating element including a linear portion disposed within the aperture of said bracket, a tubular metallic insert of relatively thin material disposed within the aperture of said bracket and in surrounding relation to said heating element linear portion, said insert including integrally therewith;

two radially outwardly extending flange-like portions, each one being disposed in snug axial relation and in direct contact with both sides of the said bracket adjacent to said aperture thereby to axially grip the bracket therebetween, an axially extending tubular portion in surrounding concentric relation to said heating element connecting the radially inner extremity of said flange-like portions, said flange-like portions respectively merging into axially adjacent reversely extending radially inwardly directed terminal flanges, with said terminal flanges in snug axial relation and in partial direct contact with the respective flange-like portions, and slightly flared at the bottom, said terminal flanges at their radially inner extremities defining openings of lesser effective diameter than said insert tubular portion, thereby to mechanically engage the periphery of said sheathed metallic heating element and secure the bracket thereto in double-gripped relation.

2. The mounting assembly of claim 1 wherein said terminal flange openings are smaller than the normal diameter of said heating element, the sheath thereof being circumferentially deformed by said terminal flange to enhance mechanical gripping thereof and electrical contact therebetween.

3. The mounting assembly of claim 1 wherein said bracket is formed from stainless steel and said insert is formed from stainless steel, thereby enhancing metal-to-metal electrical contact between said bracket, insert, and sheathed heating element.

4. The mounting assembly of any of claims 1, 2 or 3, wherein said bracket includes a second aperture therethrough, a second sheathed heating element portion therein, and a second said insert attaching and securing said second element to said bracket.

5. The mounting assembly of claim 4 wherein said insert and said heater sheath are of circular cross-section.

6. The mounting assembly of claim 4 wherein said insert and said heater sheath are of other than circular cross-section.

* * * * *